United States Patent [19]

Thompson et al.

[11] 4,205,694

[45] Jun. 3, 1980

[54] APPARATUS FOR CLEANING AND DESCALING PIPE LINES

[75] Inventors: David R. Thompson, Linthorpe; Douglas Walton, Newby; Thomas W. Bainbridge, Hutton Rudby; Leslie Tibbels, Stockton on Tees, all of England

[73] Assignee: The Walton Mole Company Limited, Middlesborough, Cleveland, England

[21] Appl. No.: 924,649

[22] Filed: Jul. 14, 1978

[30] Foreign Application Priority Data

Jul. 16, 1977 [GB] United Kingdom ..... 29977/77

[51] Int. Cl.[2] ..... B08B 3/02

[52] U.S. Cl. ..... 134/181; 134/199; 118/DIG. 11; 118/307

[58] Field of Search ..... 134/167 C–168 C, 134/170, 172, 180–181, 198–199; 118/DIG. 11, 305, 307; 266/73

[56] References Cited

U.S. PATENT DOCUMENTS

| | | | |
|---|---|---|---|
| 1,853,337 | 4/1932 | Cotton | 118/307 |
| 2,676,600 | 4/1954 | Vani et al. | 134/123 |
| 3,665,148 | 5/1972 | Yasenchak et al. | 266/73 X |
| 4,007,705 | 2/1977 | Sherer et al. | 118/307 X |

FOREIGN PATENT DOCUMENTS

| | | | |
|---|---|---|---|
| 792046 | 8/1968 | Canada | 15/DIG. 2 |

*Primary Examiner*—Robert L. Bleutge
*Attorney, Agent, or Firm*—Gipple & Hale

[57] ABSTRACT

The invention comprises a cage mountable on a pipe line and bearing a carriage movable on the cage around the pipe line. The carriage supports an elongate arm to lie in the longitudinal direction of the pipe and has a jet cleaning head reciprocable along the arm to clean the exterior of the pipe line. The cage has driven rollers thereon to drive the cage along the pipe line; and an indexing mechanism is provided to step the carriage around the pipe line.

32 Claims, 11 Drawing Figures

APPARATUS FOR CLEANING AND DESCALING PIPE LINES

DESCRIPTION

The present invention relates to apparatus for cleaning and descaling the exterior of cylindrical structures such as pipe lines, and the jackets of offshore oil rigs.

Offshore pipe lines such as oil-carrying pipe lines in the North Sea present considerable maintenance problems both from inspection and cleaning standpoints. Frequent inspection of the pipe lines for signs of stress or wear must be carried out since oil spillage from a fractured pipe not only represents a considerable financial loss but also presents a severe ecological hazard particularly for example, when occurring near fish breeding grounds, and of course constant cleaning of the pipes is a necessary preliminary to inspection and aids maintenance. Similarly, the jackets of off-shore oil rigs need to be kept clean.

Hitherto, cleaning has been carried out by divers using high pressure water jets, but as will be appreciated the conditions for instance, of depth and lack of light under which the divers are required to work are extremely hazardous and make efficient cleaning of the structures concerned impossible. In addition, the reaction produced by a high pressure water jet makes the jet extremely difficult to control, and also sets an upper limit of for example, 400 lbs/sq.inch on the jet pressure.

Accordingly the present invention provides an apparatus for cleaning and descaling the exterior of an elongate cylindrical structure comprising first means, being an arm support means, mountable on and demountable from the exterior of the structure, second means for directing a high pressure jet of fluid onto the exterior of the structure and an arm mounted on said first means and movably carrying said second means.

In one embodiment said second means is reciprocable along said arm and an indexing mechanism is provided such that at the end of each stroke of said second means, the arm is indexed or stepped a predetermined circumferential distance about the structure.

The present invention further provides an apparatus for cleaning and descaling the exterior of an elongate cylindrical structure, comprising first means mountable on the exterior of the structure so as to surround the structure, an elongate arm carried by said means and arranged to extend longitudinally of the structure, and a carriage supporting a cleaning head for directing a jet of fluid onto the exterior of the structure, said carriage being reciprocable along the arm to execute a plurality of cleaning strokes.

In a preferred embodiment the apparatus includes an indexing mechanism actuable when the cleaning head reaches the end of each cleaning stroke to index or step the arm and thus the cleaning head a predetermined distance in the circumferential direction of the structure about said first means.

The predetermined distance may be chosen such that successive cleaning strokes are contiguous with or overlap one another to insure complete cleaning of the structure exterior.

Advantageously said first means grips the exterior of the structure by way of wheels or rollers and the apparatus includes a further means actuable on completion of a full cleaning cycle about the circumference of the structure to drive the first means along the structure by way of the wheels or rollers. Said further means may be activated automatically or by a remote operator and enables the apparatus to clean successive portions of structure without having to be demounted from the pipe and relocated.

The present invention is further described hereinafter, by way of example, with reference to the accompanying drawings in which:

DETAILED DESCRIPTION OF DRAWINGS

Figure 1:
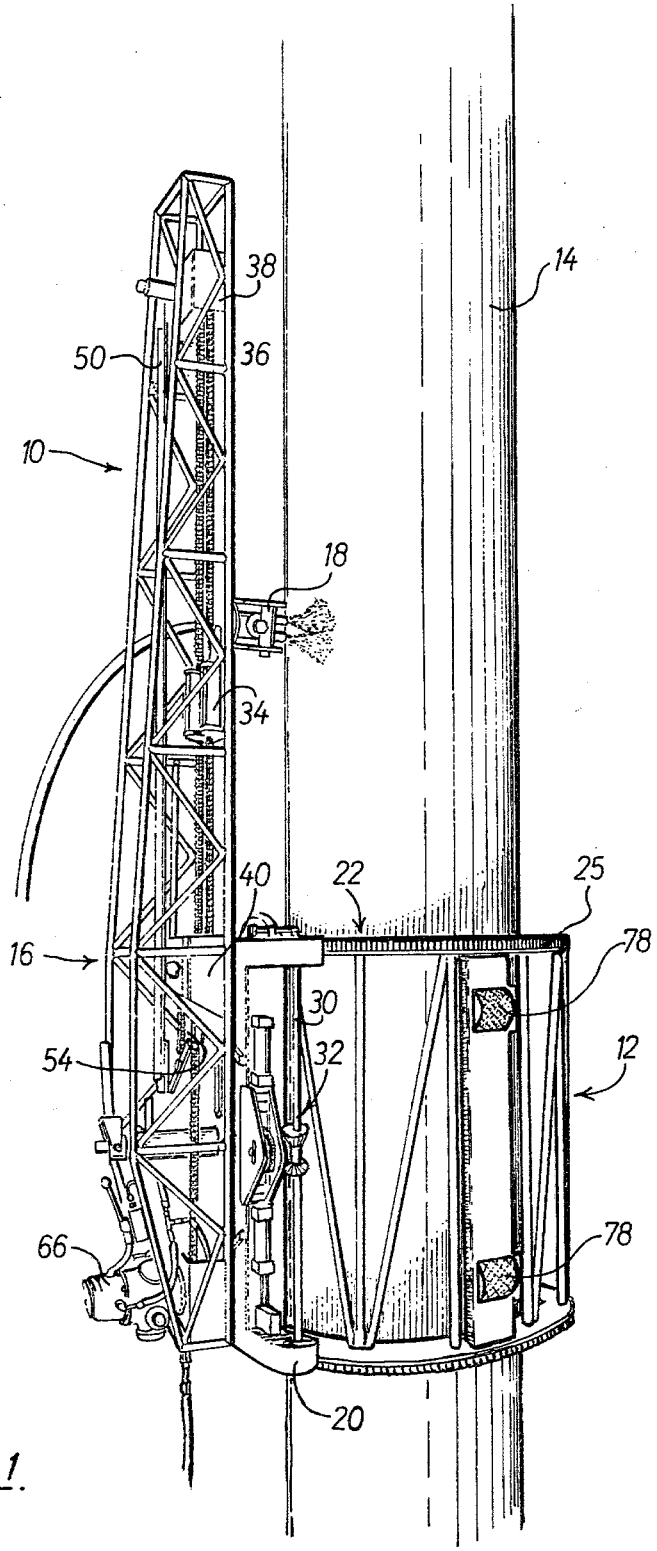
FIG. 1 is a perspective view of a preferred embodiment of the invention.

The drawings show an apparatus 10 which is primarily for descaling and cleaning the vertically disposed jackets of an off-shore oil rig, but may also be used to clean off-shore pipe lines whether vertically disposed or not.

The apparatus basically comprises a cylindrical cage 12 which encircles and grips the jacket 14 to be cleaned and has mounted thereon an axially extending arm 16 along which a cleaning head 18 is reciprocably driven. The cage 12 itself is constructed from a latticework of struts which form two semi-cylindrical halves hinged together along one pair of adjacent edges to enable mounting and dismounting of the cage 12 onto and from the pipe. The other pair of adjacent edges are joined by suitable clamps.

Figure 5:
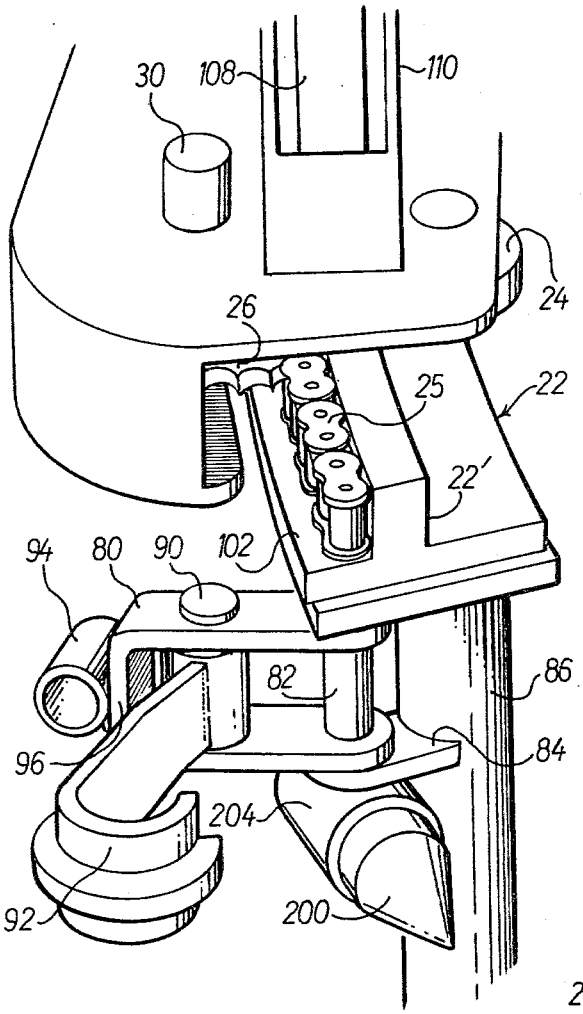
FIG. 5 is a fragmentary view of the top axial end of the cage shown in FIG. 3.
Figure 6:
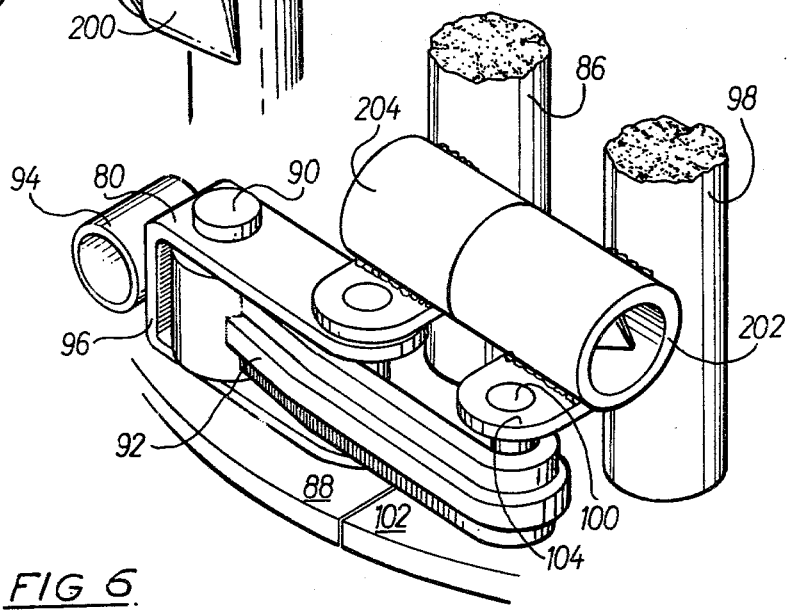
FIG. 6 is a fragmentary view showing a clamp in a closed position.

The clamps (FIGS. 5 and 6) each comprise a link in the form of a U-shaped bracket 80 pinned by a pin 82 adjacent the free ends of the arms of the bracket to be pivotable around the pin; the pin being carried at its ends respectively in a bracket 84 welded to a frame member 86 delineating one of the adjacent edges of the cage, and a plate 88 rigidly carried by the respective end of frame member 86. The U-shaped bracket also supports a pin 90 bearing, between the arms of the bracket, a clamp arm 92, and has a sleeve 94 welded or otherwise secured to the exterior face of the base or bridge member 96 of the bracket. A further frame member 98 delineates the other adjacent edge of the cage and bears adjacent each of its ends a clamp bar 100 secured at its ends respectively on a peripheral flange 102 of the cage and an arm of a bracket 104 welded or otherwise fastened to the frame member 98. The clamp arm 92 is formed with a hook-shaped end, and the clamp is fastened by hooking that end around a respective bar 100 and then, by means of a lever inserted in sleeve 94, levering the U-shaped bracket around the pin to an 'overcenter' position as shown in FIG. 6 i.e. to a position in which any force tending to separate the adjacent edges of the cage acts to keep the clamp in its closed position.

The cage also comprises guides to guide the other pair of adjacent edges to one another when the cage is closed round the jacket. The guides, one being provided adjacent each axial end of the other adjacent edges, each comprise a bolt 200 fastened to one of the other adjacent edges to extend towards the opposing one thereof, and a socket in the form of a sleeve 202 welded to the frame member 98 to receive the bolt 200 when the cage is closed on the jacket. Each bolt 200 is fastened in another sleeve 204 which is itself welded to the frame member 86, the opposing end edges of each two sleeves 202 and 204 abutting on or lying closely adjacent one another when the respective bolt is received in the sleeve 202 and the cage is clamped onto the jacket.

Figure 4:
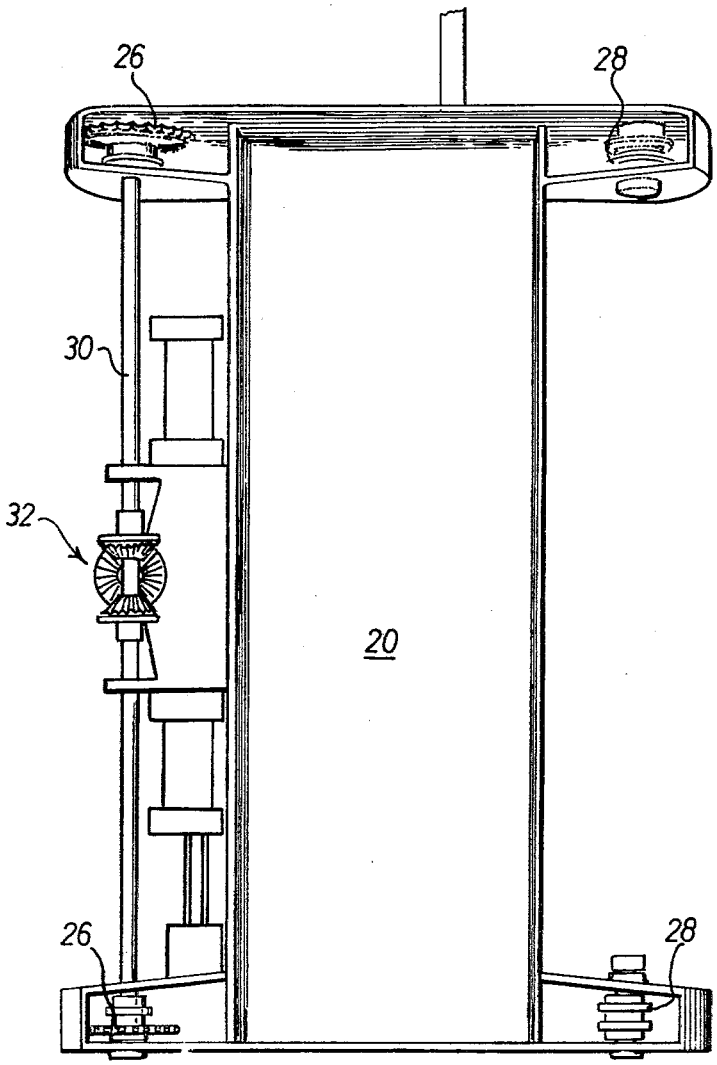
FIG. 4 is a rear view of a carriage of the embodiment showing part of a ratchet drive system.

The arm 16 is mounted on the cage 12 by way of a carriage 20 which rides on two circular tracks 22 formed at respective axial ends of the cage. Each track has an inner substantially L-shaped rail 22' (see FIG. 5 in particular) in which a respective pair of rollers 24 (FIG. 5) of the carriage run. Each roller is mounted on a pivoted arm 106 spring loaded by a spring 106' to urge the roller into contact with the inner aspect of the axially directed flange 22" of the rail. Each track also has an outer chain 25 which is held in mesh with a respective cog 26 of the carriage by engagement of the roller in the rail. The two cogs 26 are balanced by freely rotatable wheels 28 (FIG. 4) mounted on the opposite side of the rollers to the cogs, the wheels running on the edges of the peripheral flanges 102 of the cage. The cogs 26 are secured on an axle 30 which is geared intermediate its ends to a reversible ratchet drive system 32 which is further described below. Each actuation of the ratchet drive rotates the axle and thus the cogs to traverse the carriage a set distance circumferentially along the cage. The carriage 20 at its top end has mounted thereon a pair of wheels 108 the wheels being mounted in wheel housings 110 on axles 112 carried in opposite facing walls of the housings. These wheels run on the top surface of the upper edge of the upper L-shaped rail 22' and the weight of the carriage.

Since the arm 16 is mounted on the carriage 20 the former moves the cleaning head 18 with the carriage so that the head eventually traverses the full circumference of the pipe.

Figure 2:
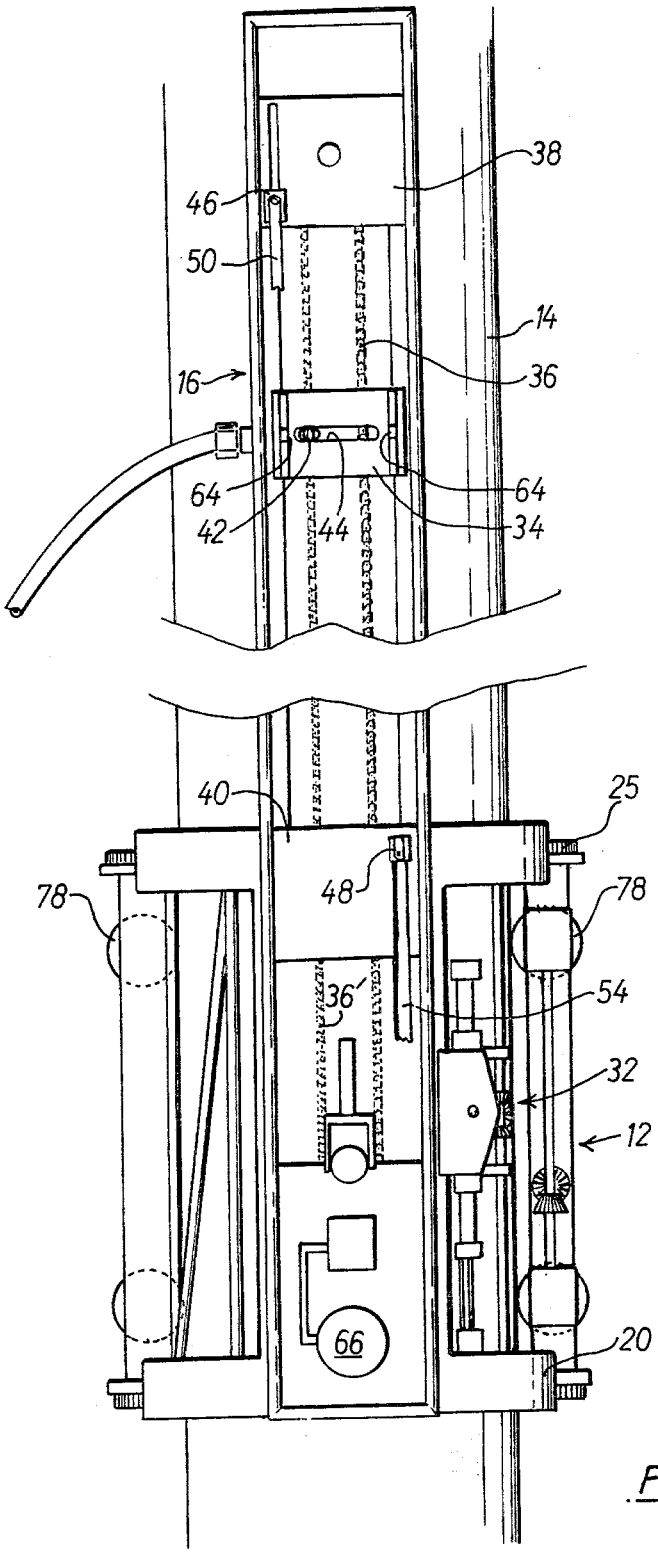
FIG. 2 is an elevation of the embodiment of FIG. 1, certain parts being omitted for clarity.
Figure 3:
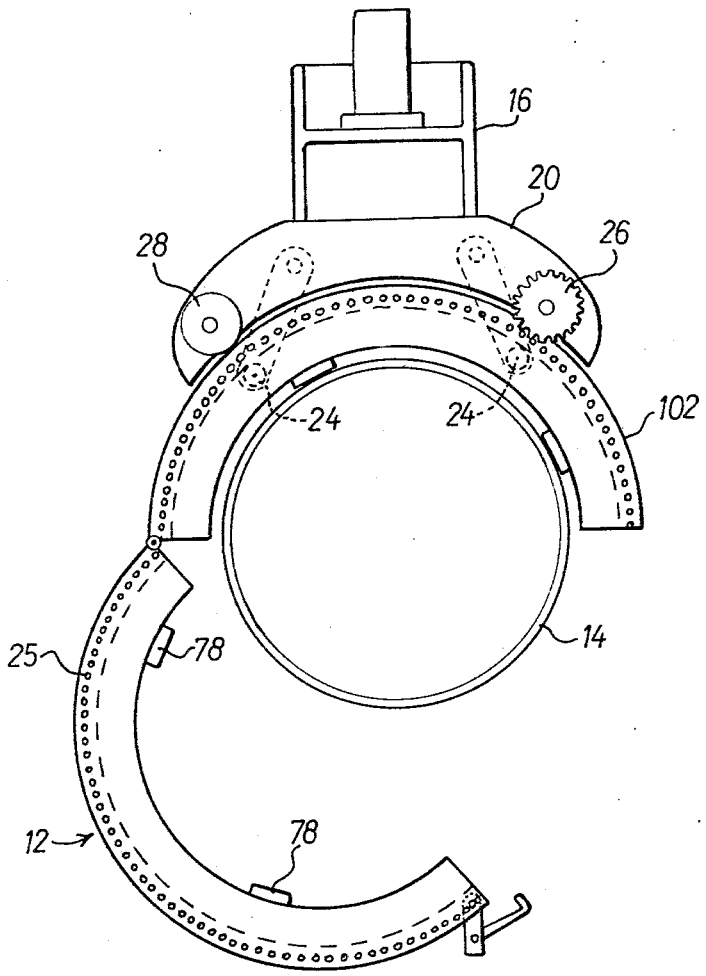
FIG. 3 is a partial section through the embodiment with a cage thereof open.
Figure 7:
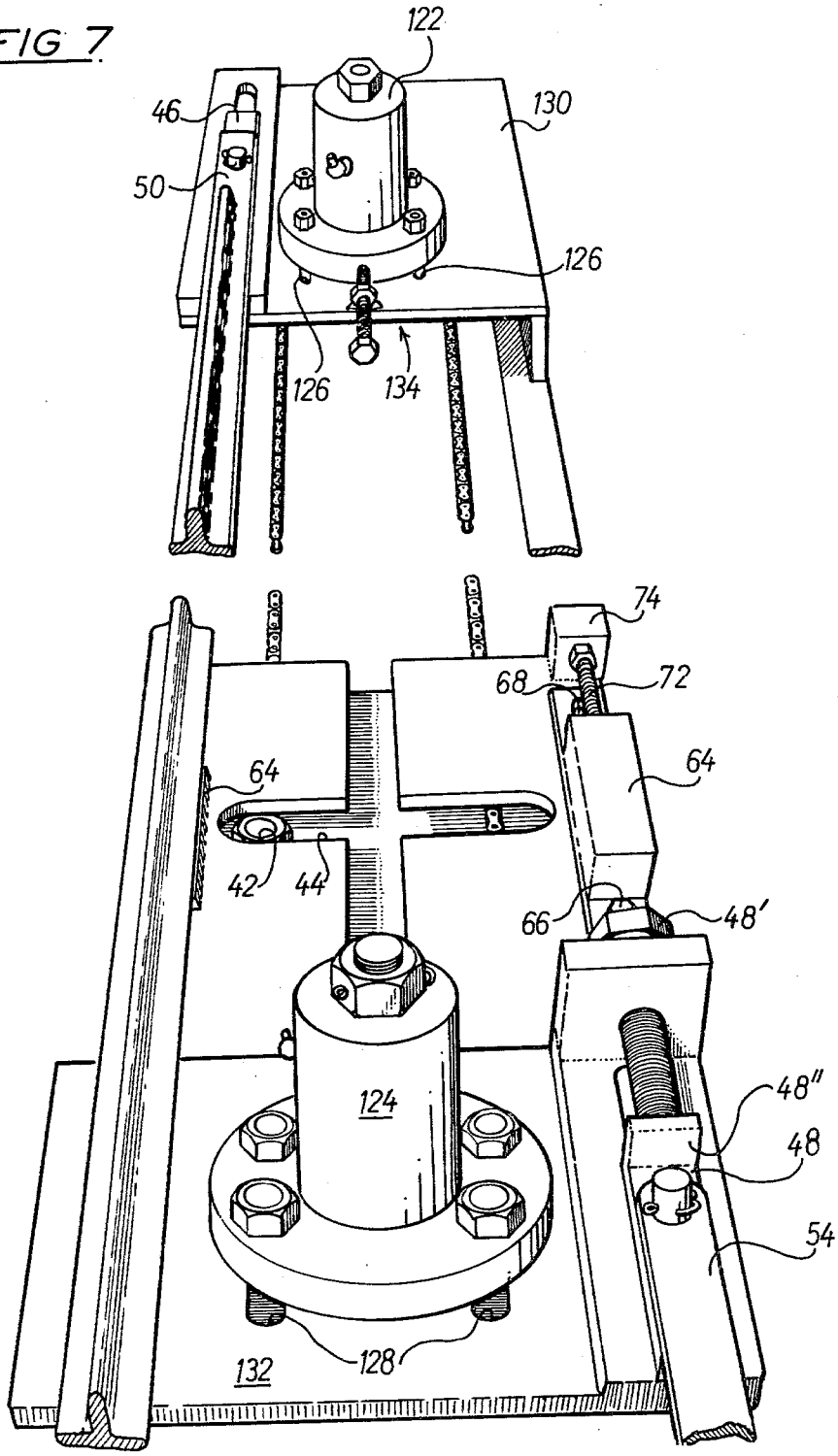
FIG. 7 is a front view of housings for chain sprockets used in a cleaning head carrying arm of the apparatus.

The cleaning head 18 is also mounted on a carriage 34 which is reciprocally driven along the arm 16 from the cage to the outermost end of the arm by way of an endless drive in the form of a chain 36. The chain is looped around sprockets 114,116 mounted on shafts 118, 120 supported in bearings 122,124 secured respectively in housings 38,40 in the arm to form two linear runs each of which passes through the head carriage 34, (see FIGS. 1, 2 and 7.)

The two bearings 122,124 (FIG. 7) are bolted in slots 126,128 formed in plates 130,132 respectively of the housings 38,40, and a bolt adjuster 134 is provided to effect precise positioning of the bearing 122 on the plate 130. By this means, the separation between the two sprockets 114,116 may be adjusted correctly to tension the chain 36.

The cleaning head carriage 34 is carried with the chain by way of a spigot 42 secured to the chain and slidable in a slot 44 which extends from one side of the head carriage to the other laterally of the direction of carriage movement. Assuming the chain 36 to be driven clockwise, when the spigot is travelling up the left hand run it will be engaged in the slot 44 at the left hand end of the latter thus carrying the carriage 34 and its cleaning head 18 upwardly towards the outer end of the arm 16. At the outer end the spigot passes over the gear in the housing 38 onto the right hand run of the chain, at the same time moving along the slot 44 to its right hand end to reverse the direction of movement of the carriage 34 and its cleaning head 18. On each complete loop of the spigot 42 the cleaning head 18 therefore executes two full strokes along the pipe.

As mentioned above, circumferential movement of the cleaning head 18 at the end of each cleaning stroke is effected by the ratchet drive 32. The latter is operated by a mechanism which is actuated each time the head carriage 34 reaches the end of its stroke.

Figure 8:
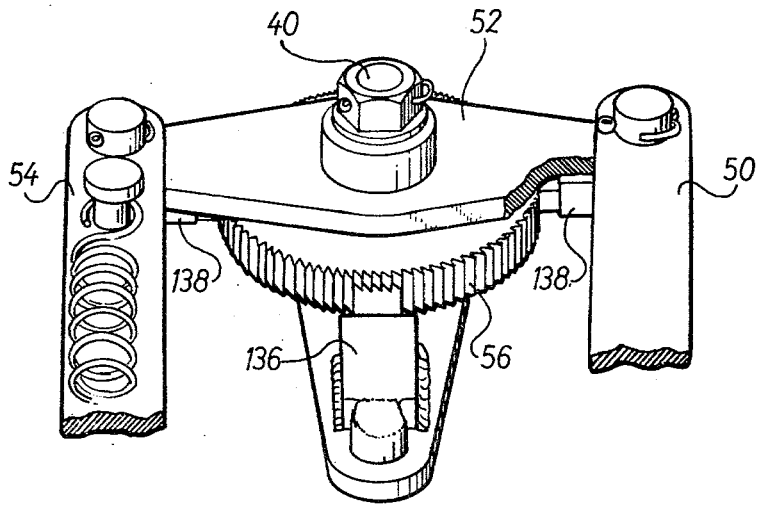
FIG. 8 shows a front view of the part of the system shown in FIG. 4 partly broken away.

The operating mechanism itself includes a respective slide 46,48 located in a slot formed in the housing plates 130,132 so as to be slidable longitudinally of the arm, the slides being biassed towards one another by way of a spring 41 as will be made evident below. The slide 46 on the upper housing 38 is located on one side thereof (the left-hand side as seen from FIG. 2) while the slide 48 is located on the opposite side of the housing 40. The two slides are inter-connected by three pivotably inter-connected levers 50, 52, 54 (see FIG. 8) two of which 50, 54 extend substantially parallel with one another along the arm 16 and are pivoted at respective ends to the third lever 52. The latter is pivotally mounted intermediate its ends such that longitudinal displacement of either lever 50, 54 rotates the lever 52 about its pivot.

The spring 41 is attached to one end of lever 54 and to the housing 40, and because the three levers are pivoted together, the spring serves to bias the slides towards one another.

The extent of the movement of the lower slide 48, and thus of the upper slide 46, may be adjusted by a bolt adjuster (FIG. 7) comprising bolt 48' passed through a bore in the housing to act as a stop for an end flange 48" of the slide; adjustment being obtained by rotation of the bolt. In the embodiment as shown, the extent of movement of both slides is equal to substantially half the diameter of the sprocket wheels 114,116 around which the chain passes.

Figure 9:
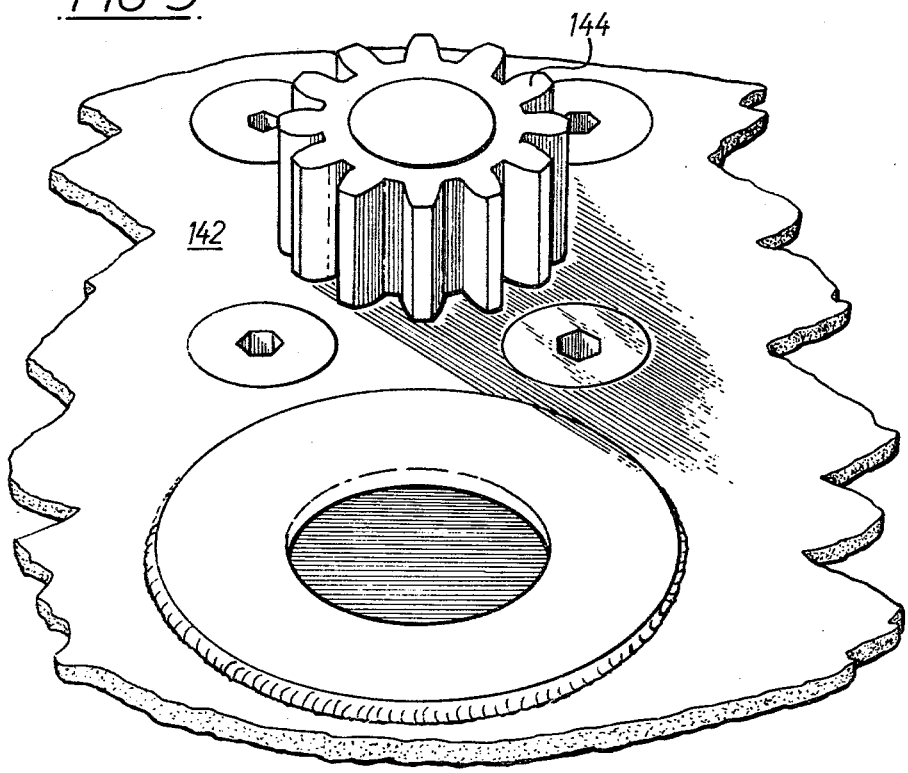
FIG. 9 is a rear view of a housing shown in FIG. 7.
Figure 10:
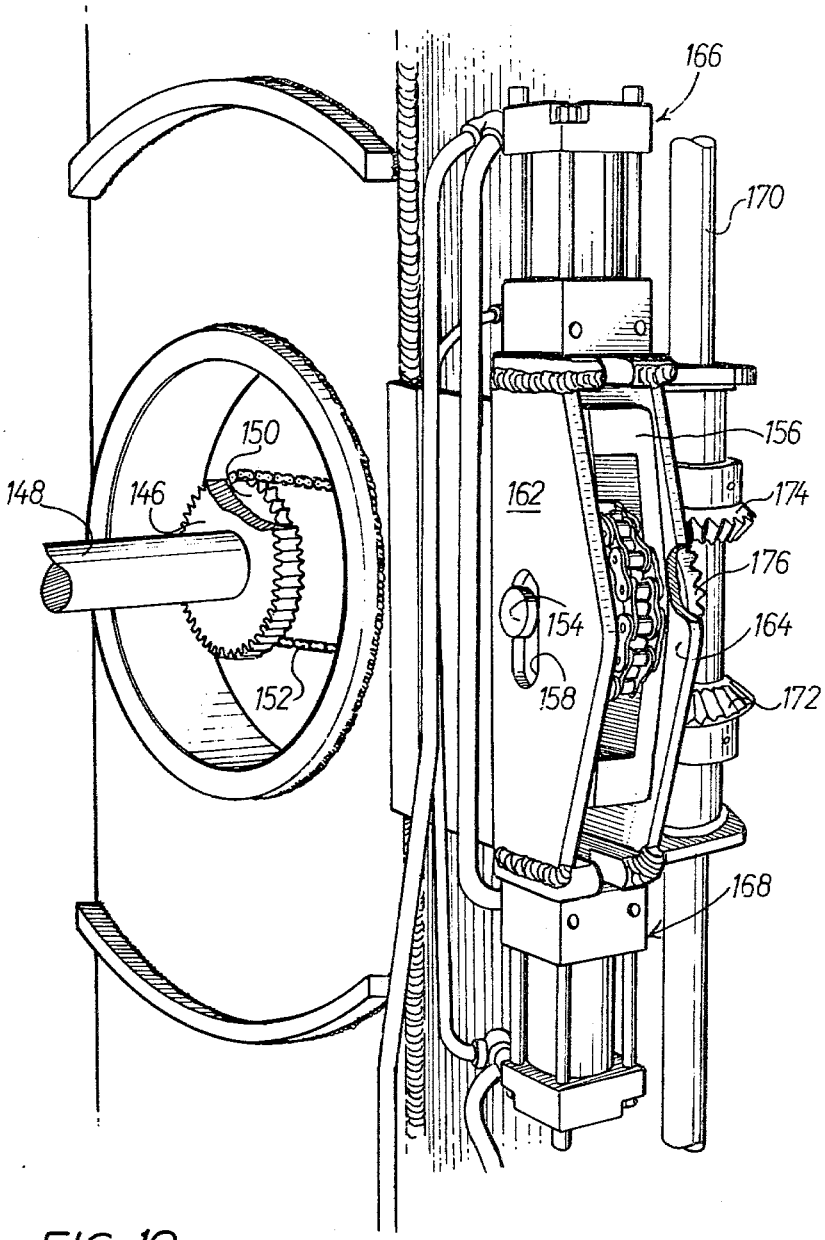
FIG. 10 is a front view of a carrier showing a gear wheel partly broken away to reveal an otherwise hidden sprocket, and a mitre gear drive driven from the gear wheel.
Figure 11:
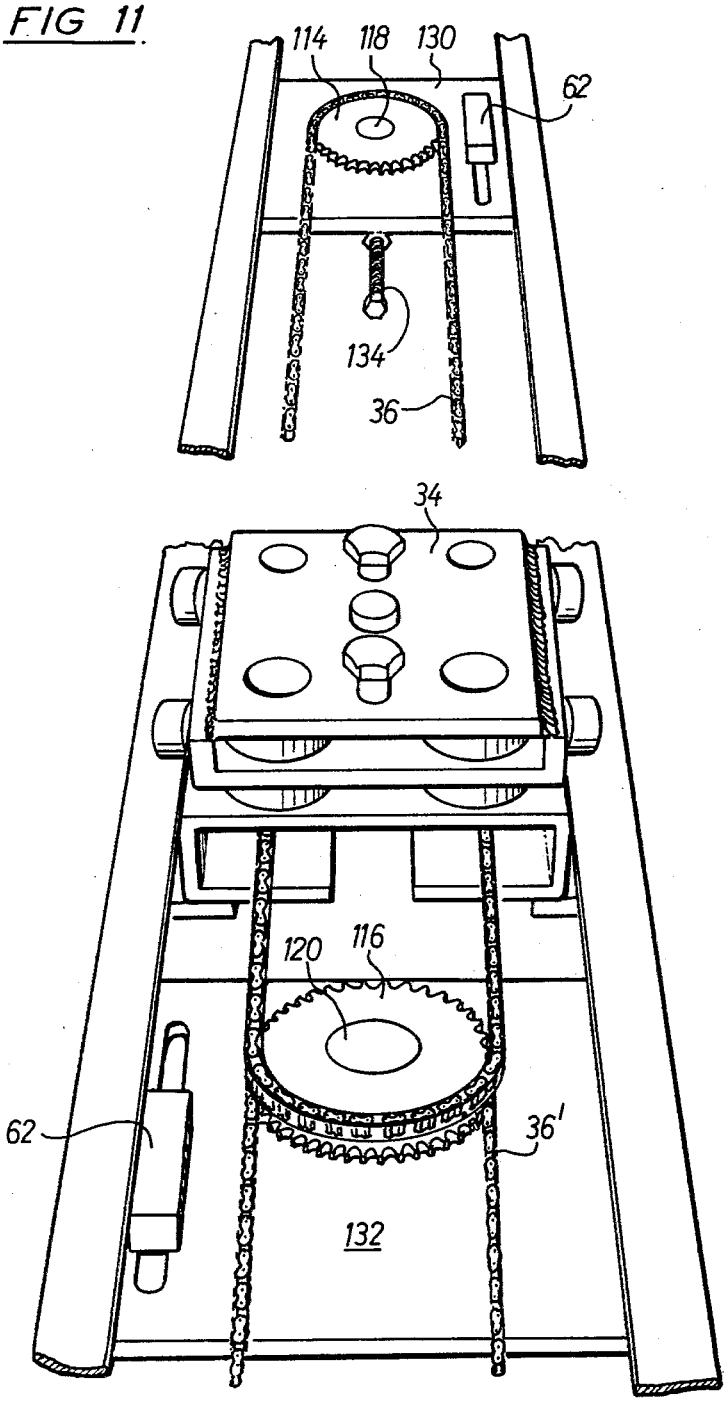
FIG. 11 shows the rear view of the housings shown in FIG. 7.

The lever 52 rotationally drives a ratchet wheel 56 (FIG. 8) mounted in the arm 16; a fixed pawl 136 being provided to prevent contrary rotation of the wheel. The lever 52 bears on its face adjacent the ratchet wheel 56, two diametrically opposed pawls 138 and the pawls act to rotate the ratchet wheel 56 on pivoting of the lever 52. The ratchet wheel is mounted fast on a shaft 140 rotatably mounted in a support plate 142 of arm 16 to provide a stub portion at the remote side of the plate, and a pinion 144 (FIG. 9) is mounted on the stub portion of the shaft to mesh with a gear wheel 146 (FIG. 10) mounted on a shaft 148 rotatably supported in carriage 34. The gear wheel is fastened to shaft 148, and the shaft bears a sprocket 150 also fastened to the shaft so that rotation of the gear wheel 146 by pinion 144 rotates the sprocket. A chain 152 is trained around the sprocket and also around a further sprocket (not shown) rotatably mounted on a shaft 154 (FIG. 11) which is carried in a housing 156 and the ends of which are received within respective slots 158,160 formed in a pair of opposed support flanges 162,164 of the carriage. The support flanges have secured thereto a pair of piston and cylinder units 166,168, namely one at the top of the support flanges and one at the bottom thereof. The pistons of these units act on the housing 156 and determine the position of the sprocket mounted on shaft 154, the slots 155,160 permitting adjustment of the position of the shaft. The two cogs 26 of the carriage respectively are mounted adjacent the ends of the shaft 170 which intermediate its ends has two axially separated mitre gears 172,174 securely mounted to the shaft.

The shaft 154 at the end adjacent shaft 170 extends from the side of the support flange and has mounted on the extending portion, a further mitre gear 176. The two mitre gears 172,174 are positioned so that the gear 176 can be meshed with either one or the other of the two mitre gears, according to the direction, clockwise or anti-clockwise, required, by a suitable positioning of the housing 156 by the piston and cylinder units 166,168. Thus, rotation of ratchet wheel 56 by movement of levers 50 and 54 acting through lever 52 is transmitted to cogs 26.

Returning now to the slides 46,48 each carries a block 62 (FIG. 11) mounted on the slide at the side of the respective plate 130,132 remote from levers 50,54. The carriage 34 also has blocks 64 (see FIG. 7) secured thereto which serves as a striker for the blocks 62 when the carriage is approaching the end of the run in each direction, thus causing movement of the levers 50 and 54. Each block 64 is adjustable in position. For this purpose, it is fastened to the carriage by two bolts 66 passing through slots 68 formed respectively in two axially directed flanges 70 of the block, and received in bores (not shown) in the carriage, and a bolt adjuster is provided on the carriage comprising bolt 72 passing through a bore (not shown) in a flange 74 of a bar 76 welded to the body of the carriage to position the end of the shank of the bolt to abut on block 64.

The chain 36 is driven by a motor 66 mounted at the base of the arm 16. The motor drives the gear in the housing 40 by way of a further gear rigidly mounted on the same axle as the first gear, and a further chain 36'. The motor 66 may be electrically powered but for safety reasons is preferably hydraulically or pneumatically driven from a remote power source.

The cage 12 also mounts four pairs of wheels 78 which grip the pipe when the cage is mounted thereon and also enable the cage 12 to be moved along the jacket.

Each pair of wheels is mounted in a channel section 178 and is driven from a separate hydraulic motor 180; the four motors thus provided being supplied via a conventional four way flow divider. Each motor drives a worm gear meshing with a pinion carried on and secured to a shaft 188 secured thereto, and each shaft also carries a mitre gear 190 secured thereto meshing with a further mitre gear 192 carried on a drive shaft 194. The drive shaft is mounted in respective bearings each carried in a crown gear housing 196 secured to the respective channel section 78, and at each end carries a bevel gear (not shown) meshing with a crown gear (not shown) securely mounted on a shaft 198 on which a respective wheel 78 is securely mounted with the shaft. By this means, drive from each of the motors 180 is transmitted to each pair of the wheels 78. The wheels may be replaced by feet which grip the pipe when the cage is mounted but of course this necessitates manual relocation of the cage after the cleaning of each section of the jacket is completed.

Actuation of the drive motor for the wheels 78 may be effected by a remote operator or automatically. In the latter case the completion of a circumferential cleaning cycle by the head 18 and carriage 20 could be used to actuate for example, a trip switch which temporarily stops the cleaning head movement and energizes the drive motors for the wheels 78 for a preset time. This preset time would be sufficient for the cage to travel along the cleaned section or jacket before stopping to commence a further cleaning cycle with the lead 18.

The arm 16 is pivotally mounted on the shaft 148 of the carriage 20 so that it may be pivoted through 180°. This enables cleaning of the uncleaned jacket section initially obstructed by the cage 20 when the latter is first mounted on the jacket. To clean this section the cage is simply driven along the jacket the required distance and the arm 18 then pivoted through 180°.

Finally, the cleaning head itself comprises one or more nozzles through which water or other cleaning fluid is forced under a pressure of up to 1500 lbs/sq. in. The source of pressurized fluid may be a pump mounted on the arm 16 or carriage 20 but is preferably remote from the apparatus, being connected thereto by fluid lines.

The cleaning fluid is conveniently seawater.

It will be evident from the above that the described embodiment is of an entirely mechanical nature and consists of simple, robust parts and mechanisms which in themselves are of a known reliability. The described embodiment is accordingly well adapted to carry out its purpose under the severe conditions in which it will be used.

We claim:

1. Apparatus for cleaning and descaling the exterior of an elongate cylindrical structure, comprising first means moveably mounted on the exterior of the structure while engaging the exterior of the structure and surrounding the structure, an elongate arm carried by said first means, said elongate arm being orientated to extend longitudinally of the structure, and a carriage supporting a cleaning head for directing a jet of fluid onto the exterior of the structure, said carriage being reciprocable along the arm to execute a plurality of cleaning strokes of the cleaning head.

2. Apparatus according to claim 1, wherein the apparatus includes an indexing mechanism actuable when the cleaning head reaches the end of each cleaning stroke to step the arm and thus also the cleaning head a predetermined distance in the circumferential direction of the structure about said first means.

3. Apparatus according to claim 2, wherein the predetermined distance is such that successive cleaning strokes effected by the cleaning head are contiguous with one another to ensure complete cleaning of the structure exterior.

4. Apparatus according to claim 2, wherein said first means comprises a carriage and a support structure therefor extending around the circumference of said cylindrical structure, the carriage being mounted on the support structure to be moveable on the support structure around the circumference of said cylindrical structure.

5. Apparatus according to claim 4, wherein the carriage comprises a drive wheel to engage on the support structure and thereby rotate the carriage around the support structure.

6. Apparatus according to claim 5, wherein the indexing mechanism comprises a pair of slides located to be moved a predetermined distance in response to movement of the reciprocable carriage respectively in the two directions of movement of the carriage, a pair of levers each connected to a respective one of the slides, and a third lever connected to said two levers remotely from the slides, said third lever being pivoted so that movement of either of said two levers on said movement of the respective slide causes the third lever to be rotated about the pivot axis in one direction; said slides being biased so that on completion of said movement they effect a return movement then to the return the third lever by rotation thereof about its pivot axis in the opposite direction; the indexing mechanism further comprising means for using the rotation of the third lever in said one direction to effect an indexed movement of the carriage of said first means on the support structure.

7. Apparatus according to claim 6, wherein said means of the indexing mechanism comprises a shaft, a ratchet wheel securely mounted on the shaft, the third lever also being mounted on the shaft to be freely rotatable thereabout, the shaft thereby constituting a pivot for the third lever, a pair of pawls mounted on said third lever respectively to engage said ratchet wheel at diametrically opposed points thereof and rotate the ratchet wheel in said one direction on movement of the respective slides, a fixed pawl to engage said ratchet wheel to prevent rotation thereof in the opposite direction, and a geared drive to transmit rotation of the ratchet wheel in said one direction to said drive wheel to cause an indexed movement of the carriage of said first means.

8. Apparatus according to claim 7, wherein said geared drive comprises a pinion securely mounted on the shaft carrying said ratchet wheel to be rotated by the shaft on rotation of the ratchet wheel in said one direction, and a gear wheel mounted on the carriage of the first means so as to mesh with said pinion to be driven thereby on rotation of the pinion; the indexing mechanism further comprising a transmission supported on said carriage to transmit drive to said drive wheel from said gear wheel.

9. Apparatus according to claim 8, wherein the said transmission comprises a chain and sprocket mechanism a sprocket of which is securely mounted on the shaft of the gear wheel to be rotated on rotation of the gear wheel.

10. Apparatus according to claim 9, wherein said drive wheel is securely mounted on a shaft and said transmission further comprises a mitre gear arrangement for transmitting drive from the chain and sprocket mechanism to said drive wheel; the mitre gear arrangement comprising a first mitre gear mounted on the shaft of said drive wheel, a second mitre gear mounted fast on a shaft on which is also securely mounted thereon on a further sprocket of the chain and sprocket mechanism whereby operation of the chain and sprocket mechanism drives said second mitre gear and thus the first mitre gear and the shaft of the drive wheel.

11. Apparatus according to claim 10 wherein said transmission comprises means for reversing the direction of rotation of said drive wheel.

12. Apparatus according to claim 11, wherein said reversing means comprises a displaceable mounting for the shaft of said second mitre gear, actuator means for displacing the mounting of said shaft and a further mitre gear securely mounted on the shaft of said drive wheel and axially spaced from said first mitre gear and arranged so that by displacement of said shaft, the second mitre gear can be engaged with either said first mitre gear or with the further mitre gear to effect reversal of the direction of rotation of said drive wheel.

13. Apparatus according to claim 12, wherein said actuator means comprises a pair of piston and cylinder units arranged so that the pistons thereof bear on opposite sides of the mounting of the shaft of the second mitre gear to determine the position of the mounting by the positions of the pistons of the two units; the pistons of the two units being displaceable to be able to move said second mitre gear between said first mitre gear and said further mitre gear.

14. Apparatus according to claim 13, wherein said piston and cylinder units are hydraulically operated.

15. Apparatus according to claim 5, wherein said drive wheel is in the form of a sprocket and said support structure provides a track in the nature of a ratchet in which the sprocket engages so that on rotation of the sprocket the carriage is rotated about the support structure.

16. Apparatus according to claim 15, wherein said track comprises a chain to constitute a ratchet to engage with the teeth of the sprocket of said drive wheel.

17. Apparatus according to claim 1, wherein said first means comprises wheels or rollers by which the means grips the exterior of the structure.

18. Apparatus according to claim 17, wherein means are provided for driving the apparatus along said cylindrical structure.

19. Apparatus for cleaning and descaling the exterior of an elongate cylindrical structure, comprising first means moveably mounted on the exterior of the structure so as to surround the structure, said first means comprising a structure with roller means which grips the exterior of the structure, an elongate arm carried by said first means and arranged to extend longitudinally of the structure, and a carriage supporting a cleaning head for directing a jet of fluid onto the exterior of the structure, said carriage being reciprocable along the arm to execute a plurality of cleaning strokes of the cleaning head and means for driving the apparatus along said cylindrical structure, said means comprising means for driving said roller means which grips the exterior of said cylindrical structure.

20. Apparatus according to claim 19, wherein the wheel or roller is securely mounted on a shaft supported in a channel section disposed to lie in the longitudinal direction of said cylindrical structure, and said drive means for the wheel or roller comprises an hydraulic motor mounted in said channel section, a worm gear connected to the motor to be driven thereby, a further shaft carrying a pinion securely therewith to mesh with the worm gear, a crown gear wheel mounted on the shaft of the wheel or roller securely therewith, a bevel gear in mesh with the crown gear wheel and carried on a drive shaft and a mitre gear arrangement for transmitting drive from the shaft carrying said pinion; the mitre gear arrangement comprising a first mitre gear securely mounted on the shaft carrying said pinion and a second mitre gear in mesh therewith carried by said drive shaft.

21. Apparatus according to claim 20, wherein a plurality of driven wheels or rollers are employed circumferentially spaced apart around said support structure, each driven wheel or roller being mounted in a respective channel section and each driven by a said drive means.

22. Apparatus according to claim 21, wherein in each channel section a further wheel or roller is mounted and arranged to be driven by a crown gear wheel through a bevel gear driven by said drive shaft whereby the two wheels or rollers in each channel are driven from said hydraulic motor housed in the channel section.

23. Apparatus according to claim 22, wherein four pairs of circumferentially spaced wheels or rollers are employed.

24. Apparatus according to claim 1 wherein said arm is pivotably mounted so that the direction along said cylindrical structure in which it is arranged can be reversed.

25. Apparatus according to claim 1 wherein said first means comprises a structure formed of two semi-cylindrical halves hinged together along one pair of adjacent edges and being provided along the other pair adjacent edges with means for fastening the other two adjacent edges together to permit the first means to be fastened round the said cylindrical structure.

26. Apparatus according to claim 25, wherein said fastening means comprises a hook shaped clamp arm pivotably mounted on a link itself pivotably mounted on one of the other adjacent edges and a clamp bar rigidly mounted on the opposing one of the other adjacent edges, whereby the clamp arm can be hooked around the clamp bar and then by means of said link moved to an overcentred position.

27. Apparatus according to claim 25, wherein a fastening means is provided adjacent each axial end of said other adjacent edges.

28. Apparatus according to claim 25, wherein said other adjacent edges are provided with guide means to permit the other adjacent edges to the correctly positioned in relation to one another in closing the two semi-cylindrical halves of the first means.

29. Apparatus according to claim 28, wherein the guide means comprises one or more bolts rigidly mounted on one of the other adjacent edges to extend in the direction of the opposing one of the other adjacent edges and one or more corresponding sockets mounted on the opposing one of the other adjacent edges to receive the bolt or the bolts.

30. Apparatus according to claim 25 wherein the two semi-cylindrical halves of the first means are formed by a lattice work of struts.

31. Apparatus for cleaning and descaling the exterior of an elongate cylindrical structure comprising first means mountable on the exterior of the structure so as to surround the structure, an elongate arm carried by said first means oriented to extend longitudinally of the structure, and a carriage supporting a cleaning head for directing a jet of fluid onto the exterior of the structure, said carriage being reciprocable along the arm to execute a plurality of cleaning strokes of the cleaning head, said carriage and a support structure therefor extending around the circumference of said cylindrical structure, the carriage being mounted on the support structure to be moveable on the support structure around the circumference of said cylindrical structure, said carriage comprising a drive wheel to engage on the support structure and rotate the carriage around the support structure, said apparatus also including an indexing mechanism actuable when the cleaning head reaches the end of each cleaning stroke to step the arm and cleaning head a predetermined distance in the circumferential direction of the structure about said first means, said indexing mechanism comprising a pair of slides located to be moved a predetermined distance in response to movement of the reciprocable carriage respectively in the direction of movement of the carriage, a pair of levers, each connected to a respective one of the slides, and a third lever connected to said two levers remotely from the slides, said third lever being pivoted so that movement of either of said two levers of said movement of the respective slide causes the third lever to be rotated about the pivot axis in one direction, said slides being biased so that on completion of said movement they effect a return movement to the return of the third lever by rotation thereof about its pivot axis in the opposite direction: the indexing mechanism further comprising means for using the rotation of the third lever in said one direction to effect an indexed movement of the carriage of said first means on the support structure.

32. Apparatus for cleaning and descaling the exterior of an elongate cylindrical structure when the cylindrical structure is presented in one of a plurality of positions including vertical and horizontal comprising first support means moveably mounted on the exterior of the structure so as to surround the structure, said first support means being provided with roller means mounted thereto which engage the exterior of the cylindrical structure, an elongate arm carried by said first support means extending longitudinally along the cylindrical structure and a carriage supporting a cleaning head moveably mounted on said elongate arm, said cleaning head being adapted to direct a jet of pressurized liquid onto the exterior of the cylindrical structure, said carriage being reciprocable along the arm allowing a plurality of cleaning strokes of the cleaning head and means for driving the apparatus along said cylindrical structure, said driving means comprising means for driving said roller means and moving said first support means along the exterior of said cylindrical structure while the roller means substantially continuously engage the exterior of the cylindrical structure.

* * * * *